United States Patent [19]

Serediuk

[11] 4,114,222

[45] Sep. 19, 1978

[54] HAIRBRUSH

[76] Inventor: Vladislaus Serediuk, Schusterstr. 1, 7800 Freiburg i. Br., Fed. Rep. of Germany

[21] Appl. No.: 739,341

[22] Filed: Nov. 5, 1976

[30] Foreign Application Priority Data

Nov. 8, 1975 [DE] Fed. Rep. of Germany ..... 2550265

[51] Int. Cl.[2] ..... A46B 9/08

[52] U.S. Cl. ..... 15/186; 15/201; 132/151

[58] Field of Search ..... 15/186, 201, 202, 203, 15/143 R, 144 R, 145, 176, 190, 189; 132/151, 152

[56] References Cited

U.S. PATENT DOCUMENTS

| | | | |
|---|---|---|---|
| 1,142,698 | 6/1915 | Grove et al. | 15/117 |
| 1,206,031 | 11/1916 | Ritter, Sr. et al. | 15/192 |
| 1,471,527 | 10/1923 | Proctor | 132/151 X |
| 2,482,928 | 9/1949 | Neff et al. | 15/186 X |
| 2,556,691 | 6/1951 | Harshbarger | 15/186 X |
| 2,558,290 | 6/1951 | Brown et al. | 15/202 |
| 2,665,443 | 1/1954 | Simon | 15/1.5 A |
| 3,314,096 | 4/1967 | Berliner | 15/187 |
| 3,651,532 | 3/1972 | Wettburg | 15/186 |

FOREIGN PATENT DOCUMENTS

| | | | |
|---|---|---|---|
| 791,570 | 9/1935 | France | 15/176 |
| 2,042,282 | 3/1972 | Fed. Rep. of Germany | 15/186 |
| 1,792 of | 1901 | Fed. Rep. of Germany | 15/176 |

*Primary Examiner*—Peter Feldman

*Attorney, Agent, or Firm*—Michael J. Striker

[57] ABSTRACT

A hairbrush has a body member provided with a plurality of apertures, and a plurality of substantially rigid pins mounted on the body member and each extending through one of the apertures. Each pin extends through the respective aperture with play relative thereto so as to be pivotable relative to the body member. Each pin has a shaft part extending with play through a front portion of the aperture adjacent to the outer surface of the body member, and a head part received with play in an enlarged rear portion of the aperture.

28 Claims, 4 Drawing Figures

HAIRBRUSH

BACKGROUND OF THE INVENTION

The present invention relates to a hairbrush. More particularly it relates to such a hairbrush which comprises a body member and a plurality of substantially rigid pins mounted on the body member.

Hairbrushes of this type are already known in the art. In such a hairbrush steel pins are fixedly embedded with their ends into a rubber pad mounted on the body member of the brush.

A disadvantage of such hairbrushes is that the pins are not pivotable relative to the body member, and therefore not able to engage individual strands of hairs to be treated so as to make a loosely shaped hairstyle.

Another disadvantage of such hairbrushes is that the metallic pins are often electrostatically charged, which complicates making a shaped hairstyle.

Still another disadvantage of these hairbrushes consists in that a hairdryer operating simultaneously with and at a small distance from the hairbrush heats up the metallic pins, and that the thus heated pins do harm to the hair to be treated.

Finally, the rubber pad, when subjected to heat generated by a hairdryer, becomes progressively more and more brittle which results in loosening of the metallic pins.

SUMMARY OF THE INVENTION

Accordingly, it is an object of the present invention to provide an improved hairbrush which avoids the aforementioned disadvantages.

More particularly, it is an object of the invention to provide an improved hairbrush which enables the user to engage individual strands of hairs and to place such strands in a desirable position and shape, so as to obtain a loose shaped hairstyle.

Another object of the present invention is to provide a hairbrush having pins which do not become electrostatically charged and thereby do not complicate the making of a shaped hairstyle.

Still another object of the present invention is to provide an improved hairbrush having pins which are not — or not objectionably — heated under the heat action of a hairdryer and thereby do not do harm to hair to be treated.

An additional object of the present invention is to provide an improved hairbrush the parts of which are not destroyed when subjected to heat, so that the new hairbrush has a longer lifetime than the conventional hairbrushes.

With keeping of these objects, and with others which will become apparent hereafter, the hairbrush in accordance with the present invention, briefly stated, comprises a body member having a plurality of apertures, and a plurality of substantially rigid pins mounted on the body member and each extending through one of said apertures with play relative to the same so as to be pivotable relative to the body member.

Each of the apertures has a front portion open at the outer surface of the body member and an enlarged rear portion. Each pin has a shaft part extending through the front portion of the aperture, and a head part received in the enlarged rear portion thereof.

At least the shaft part of the pins is constituted of wood. The body member of the hairbrush is configurated of at least two body parts. One of these parts is provided with the apertures for receiving the pins therein. The pins are inserted into the apertures and thereafter fixed in their position by means of another part of the body member which engages with said one part thereof.

The shaft part of the pins has conical shape and narrows from the head portion towards its outer end at least over a length thereof corresponding to the length of the front portions of the apertures.

The hairbrush of the present invention comprises an intermediate layer located inside the body member so that the head parts of the pins backwardly abut against this layer. In a round-shaped hairbrush having a body of a circular cross-section, the pins are mounted on the circular body, and the intermediate layer has a cylindrical shape. The intermediate layer is configurated as a springy member. It can be constituted of elastic material, for example of rubber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
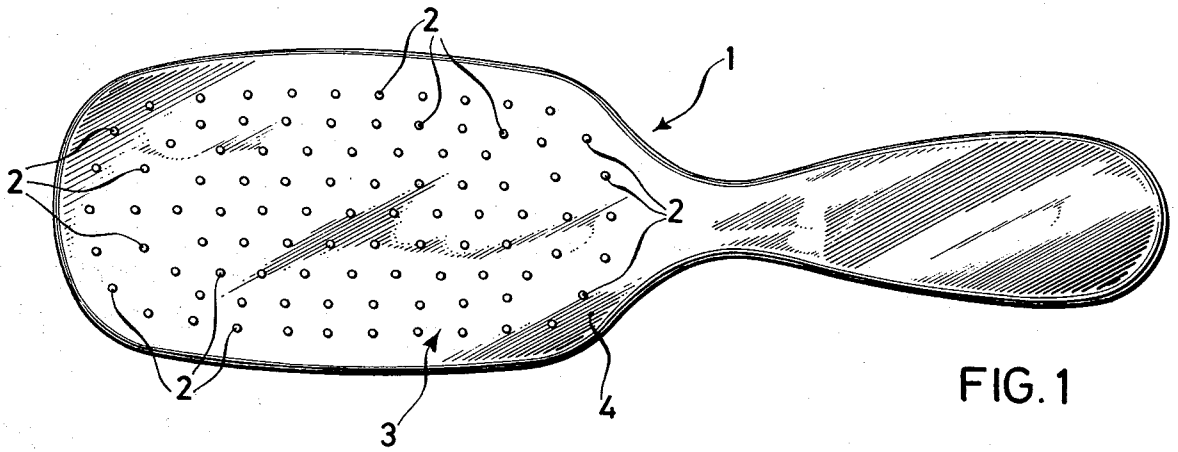
FIG. 1 is a top-plan view of a hairbrush according to the present invention.

A hairbrush which embodies one form of the invention is shown in FIG. 1 and identified in toto by reference numeral 1. Pins which are already known in the art and perform connecting functions are spaced from one another at relatively large intervals therebetween to provide a possibility of engaging not individual hairs, but strands of hairs so as to make a hairstyle of a loose and natural appearance.

Figure 2:
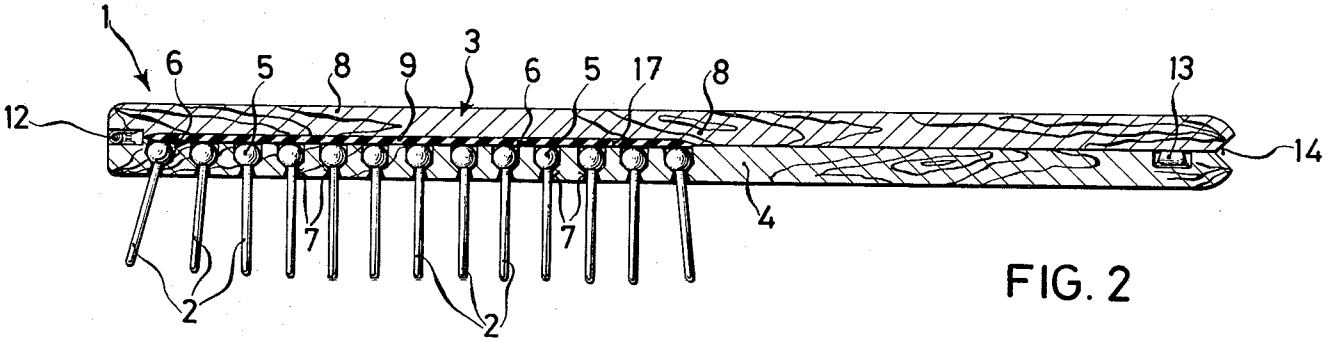
FIG. 2 is a longitudinal section of FIG. 1.

FIG. 2 shows clearly the construction of the hairbrush in accordance with this embodiment of the invention. A body member 3 of the hairbrush is substantially flat and is constituted by separate parts. Each of the pins consists of a shaft part 2 and a head part 5. The body member 3 is provided with apertures each of which has a front portion 7 adjacent to the outer surface of the body member, and a rear enlarged portion 6. The head part 5 of each of the pins is received in the rear enlarged portion 6 of the aperture with play relative to the same. The front portion 7 of each of the apertures has a cross-section larger than that of the shaft part 2 so that the shaft part 2 extends through the front portion 7 of the aperture with play relative to the same. This enables the pins to be pivoted relative to the body member 3. In the embodiment shown in FIG. 2 the body member 3 consists of two separate substantially flat body parts. The rear enlarged portions 6 of the apertures for receiving therein the head parts 5 of the pins are provided in a lower body part 4. The pins are inserted into the apertures from above of said lower body part 4 and then fixed in its position by means of an upper body part 8 formed as a deck part when the upper body part 8 abuts against the lower body part 4. The body parts 4 and 8 are detachably connected with one another so as to provide a possibility to be connected with and to be separated from each other.

Figure 3:
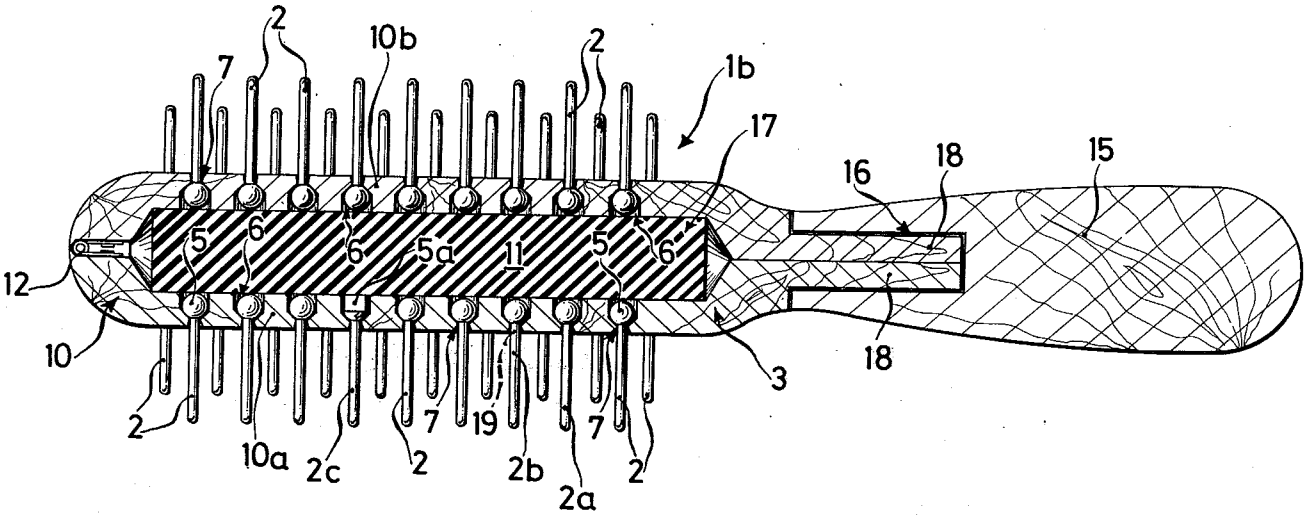
FIG. 3 is a longitudinal view of the hairbrush according to the present invention configurated as a round hairbrush; and, FIG. 4 is a transverse section of FIG. 3.

In the constructions shown in FIGS. 2 and 3, the above mentioned connection of the body parts with one another is performed by means of a pivot 12 having cooperating parts each mounted on a respective one of said flat body parts 4 and 8 or of cup-shaped body parts 10*a* and 10*b*. The pivot 12 is mounted on an end of the body parts spaced from a handle member 15 which is connected to the body member 3. This enables the hairbrush to be opened for replacing the damaged pins by new pins.

In the flat hairbrush shown in FIG. 2 the handle member is configurated of two handle parts each connected to a respective one of the body parts 4 and 8. The handle parts are provided with press fastening means 13 which fasten the handle parts to one another and provide secure abutting of the inner surfaces of the body parts 4 and 8 against each other. Mating outer edge portions of the handle parts are provided with notches 14 communicating with one another. The notches permit gripping the handle parts and separating them from one another to open the hairbrush.

The above mentioned press fastening means are also available for the construction of the hairbrush shown in FIG. 3. In this case the body member is provided with an extension formed at an end thereof adjacent to the handle member 15 and constituted of two extensions 18 of the body parts 10*a* and 10*b*. A groove 16 is formed in a handle member 15 and adapted to receive in and to engage the extension of the body member. The inner surface of the groove 16 and the outer surface of the extension of the body member is so dimensioned as to engage one another with a friction fit. The substantial elasticity of the thus connected parts is particularly desirable to provide pressing the handle member onto the extension of the body member and firmly connecting these parts with one another. Interengaging formations can also be provided on the respective surfaces of the extensions 18 and the groove 16.

As clearly shown in FIG. 2, the hairbrush in accordance with the present invention comprises an intermediate layer 9 formed as an insert 17 inside a body member 3 of the hairbrush. The insert 17 is positioned adjacent to the inner side of the rear enlarged portions 6 of the apertures and thereby adjacent to the head parts 5 of the pins so as to engage frictionally the head parts 5. The insert 17 is configurated as a springy part and can be constituted of elastic material, for example of rubber. This permits the pins to be moved in a longitudinal direction thereof.

The pins preferably are integral members of wood. On the other hand, the head part 5 and the shaft part 2 of the pin can be configurated by separate members, and the head part 5 can be of a material other than wood, for example of plastic material, metal and the like. In this case the shaft part 2 is received in the head part 5 and fixedly connected thereto by means of an adhesive. This can be advisable for specific applications of the hairbrush, and also for improving the above mentioned frictional engagement of the pins with the intermediate layer 9.

Figure 4:
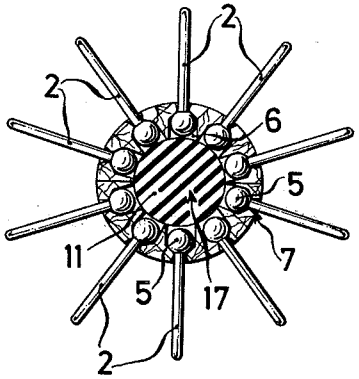

FIG. 3 and 4 show a further embodiment of the hairbrush in accordance with the present invention, and particularly the round-shaped hairbrush. The round-shaped hairbrush has a body member 10 of a circular cross-section; and the enlarged portions 6 for receiving therein the head parts 5 of the pins are formed in the circular body member 10. The circular body member 10 extends in a longitudinal direction and is constituted of two cup-shaped body parts 10*a* and 10*b*. In this case, the pins can be inserted into the apertures from the inner surfaces of the cup-shaped body parts 10*a* and 10*b*. For fixing the pins in its position an intermediate layer 11 is provided which is inserted in a recess of a body member bounded by inner surfaces of the cup-shaped body parts 10*a* and 10*b*. The intermediate layer 11 is of a cylindrical shape and can be configurated as the intermediate member 9 in the first embodiment of the invention shown in FIGS. 1 and 2, that is, as a springy member constituted for example of elastic material.

As clearly shown in FIGS. 2–4, the front portion 7 of each of the apertures has a cross-section, increasing from the rear enlarged portion 6 of the apertures towards the outer surface of the body member. This improves pivotal movement of the pins and, on the other hand, provides an abutment which limits this pivotal movement of the pins to a certain degree. In this case, the shaft part 2 of the pin has a cross-section narrowing in a direction from the head part 5 towards a distal end of the shaft part 2 spaced from the head part 5, as shown in FIG. 3 in dashed lines. The shaft part 2 of the pin is conical either over a length corresponding to the length of the front portion 7 of the aperture, or over the entire length of the shaft part 2 that is from the head part 5 to the spaced distal end of the shaft part.

The rear enlarged portion 6 of the aperture for receiving therein the head part 5 of the pin has a diameter of a value substantially between two and eight millimeters and the head part 5 of the pin has a diameter slightly smaller than the diameter of the rear enlarged portion 6 of the aperture by an amount approximately equal to half of a millimeter. The length of the shaft part 2 of the pin can also vary, and preferably has a value equal to at least from eight to thirty millimeters.

As shown in the drawing, at least a section of the head part 5 of the pin adjacent the shaft part 2 thereof has a spherical shape. However, the head part 5 can have a cylindrical shape as shown in FIG. 3 and identified by a reference numeral 5*a*. The pin having the cylindrical head part 5 is particularly simple to manufacture, which is especially important with regard to a pin configurated as an integral wooden member.

The hairbrush in accordance with the present invention provides for highly advantageous results. The pins of the hairbrush perform pivotal movement relative to the body member and thereby permits the obtaining of a hairstyle better than hairstyles obtained with use of the heretofore known hairbrushes. The pivotable pins enable it to engage individual strands of hairs and places these strands into a particularly favorable position and shape and thereby making the hairstyle of a loose and natural appearance.

The wooden pins do not become electrostatically charged. They enter hairs to be treated and move in engagement therewith more easily and with lesser friction than the conventional hairbrushes. This further facilitates making the hairstyle and favors improving its appearance.

At the same time, the wooden pins do not become heated when subjected by heat action of a hairdryer operating simultaneously with and at a small distance from the hairbrush, and therefore, the pins do not do harm to the hair to be treated.

The hairbrush in accordance with the present invention has a longer life-time than the conventional hairbrushes because it does not have outer rubber parts which could be damaged when subjected to heat action of the hair dryer.

It will be understood that each of the elements described above, or two or more together, may also find a useful application in other types of constructions differing from the types described above.

While the invention has been illustrated and described as embodied in a hairbrush, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hairbrush, comprising a substantially rigid body member having an inner hollow and a plurality of apertures communicating with said inner hollow; a plurality of substantially rigid elongated pins each extending through one of said apertures and mounted in said body member, each of said pins having a shaft part and a head part; and mounting means for mounting said pins in said body member including a front portion formed in each of said apertures adjacent to and open at an outer surface of said body member and dimensioned to receive said shaft portion of a respective one of said pins with radial play, an enlarged rear portion formed in each of said apertures and open at an inner surface of said body member facing toward said hollow and dimensioned to completely receive said head part of a respective one of said pins with clearance, and an elastic insert located in said hollow of said body member and adjacent to said enlarged rear portions of said apertures so as to abut against said head parts of said pins when said head parts are received in said enlarged rear portions of said apertures, so that said pins are elastically urged toward said outer surface of said body member under the action of said elastic insert upon said head parts of said pins, whereas at the same time said pins can be displaced in the direction of elongation thereof through said apertures relative to said body member and can also be pivoted, while being simultaneously guided during their displacement by the location of said head parts of said pins in said enlarged rear portions of said apertures.

2. The hairbrush as defined in claim 1, wherein at least said shaft parts of said pins are of an antistatic material so as to resist development of an electrostatic charge during use of the hairbrush, whereby interference of such electrostatic charge with the brushing and styling of the hairs of the user is prevented.

3. The hairbrush as defined in claim 1, wherein said shaft part of said pins is of an antistatic material so as to resist development of an electrostatic charge during use of the hairbrush, whereas said head part of each of said pin is of metal so as to form, together with a respective wall portion bonding said enlarged portion of a respective one of said apertures, a pivot having high anti-friction characteristics.

4. The hairbrush as defined in claim 2, wherein said shaft part of each of said pins is of wood.

5. The hairbrush as defined in claim 2, wherein each of said pins is an integral member of wood comprising said head part and said shaft part.

6. The hairbrush as defined in claim 1, wherein at least a section of said head part of each of said pins ajacent said shaft part thereof has a spherical shape.

7. The hairbrush as defined in claim 5, wherein said head part of each of said pins has a cylindrical shape.

8. The hairbrush as defined in claim 4, wherein said head part and said shaft part of each of said pins are configurated by separate members, said shaft part of said pin being received in said head part and fixedly connected to the latter.

9. The hairbrush as defined in claim 8, further comprising connecting means for fixedly connecting said shaft part of said pin to said head part thereof, said means being a layer of adhesive.

10. The hairbrush as defined in claim 8, wherein said head part of said pin is of plastic material.

11. The hairbrush as defined in claim 1, wherein said rear enlarged portion of each of said apertures and said head part of each of said pins have circular cross sections, the cross-section of said head part of said pin being of a smaller diameter than the cross-section of said rear enlarged portion of said aperture.

12. The hairbrush as defined in claim 11, wherein said cross-section of said rear enlarged portion of said aperture is of a diameter having a value substantially between 2 and 8 millimeters, and said cross-section of said head portion of said pin being of a diameter smaller than the diameter of said cross-section of said rear enlarged portion of said aperture by an amount approximately equal to half of a millimeter.

13. The hairbrush as defined in claim 1, wherein said shaft parts of said pins are each of a length equal to at least between 8 and 30 millimeters.

14. The hairbrush as defined in claim 1, wherein said front portions of each of said apertures has a cross-section which increases from said rear enlarged portion of said aperture towards the outer surface of said body member.

15. The hairbrush as defined in claim 1, wherein said body member is constituted by at least two cup-shaped body parts which are connected to each other, said rear enlarged portions of said apertures being formed in at least one of said body parts.

16. The hairbrush as defined in claim 15, wherein another of said body parts is configurated as a deck part, said insert being located between said one body part and said deck part.

17. The hairbrush as defined in claim 1, wherein said insert is configurated as a springy insert.

18. The hairbrush as defined in claim 1 of the type having a body member of a substantially circular cross-section, wherein said insert is of a cylindrical shape.

19. The hairbrush as defined in claim 15, further comprising connecting means for connecting said body parts to each other, said connecting means including a pivot having cooperating parts mounted on the respective body parts.

20. The hairbrush as defined in claim 19, further comprising a handle member connected to said body member, said cooperating parts of said pivot being mounted on the respective body parts at ends thereof opposite to said handle member.

21. The hairbrush as defined in claim 20, wherein said handle member is constituted of at least two handle parts each connected to a respective one of said body parts; and further comprising press fastening means mounted on said handle parts for fastening said handle parts to one another and thereby connecting said body parts with each other.

22. The hairbrush as defined in claim 21, wherein said handle parts have mating outer edge portions, said outer edge portions having notches communicating with one another and adapted for gripping said handle parts and thereby separating them from one another.

23. The hairbrush as defined in claim 1, further comprising a handle connected to said body member, said body member having a projection at its end adjacent said handle member, said handle member having a groove adapted for receiving therein said projection of said body member while being in a operational position.

24. The hairbrush as defined in claim 23, wherein an outer surface of said projection and an inner surface of said groove are dimensioned to engage one another with a friction fit.

25. The hairbrush as defined in claim 23, wherein said outer surface of said projection and said inner surface of said groove are provided with interengaging formations.

26. The hairbrush as defined in claim 24, wherein said outer surface of said projection and said inner surface of said groove are provided with interengaging formations.

27. The hairbrush as defined in claim 1, wherein said shaft part of each of said pins has a first end adjacent said head part thereof, a second end spaced from said first end, and a section located within said front portion of each of said apertures, said section of said shaft part of said pin being conical and narrowing in a direction from said first towards said second end of said shaft part.

28. The hairbrush as defined in claim 1, wherein said shaft part of each of said pins has a first end adjacent said head part thereof and a second end spaced from said first end, said shaft part being conical and narrowing from said first end towards said second end.

* * * * *